United States Patent [19]

Rokop et al.

[11] Patent Number: 4,530,393

[45] Date of Patent: Jul. 23, 1985

[54] APPARATUS FOR SHROUDING IN A CONTINUOUS CASTING MACHINE

[75] Inventors: Joseph Rokop, Pittsburgh; Nikolaus Rokop, Bridgeville, both of Pa.

[73] Assignee: Rokop Corporation, Pittsburgh, Pa.

[21] Appl. No.: 516,044

[22] Filed: Jul. 22, 1983

[51] Int. Cl.[3] ..... B22D 11/00; B22D 11/10

[52] U.S. Cl. ..... 164/415; 164/437; 222/603

[58] Field of Search ..... 164/415, 437, 439, 337, 164/335; 222/603, 606, 607

[56] References Cited

U.S. PATENT DOCUMENTS

| | | | |
|---|---|---|---|
| 3,439,735 | 4/1969 | Holmes | 164/259 |
| 3,482,621 | 12/1969 | Halliday | 164/415 |
| 3,616,843 | 11/1971 | Newhall et al. | 164/146 |
| 3,756,305 | 10/1973 | Haussner | 164/481 |
| 3,766,961 | 10/1973 | Bunting | 164/415 |
| 3,921,704 | 11/1975 | Tozaki | 164/415 |
| 4,199,087 | 4/1980 | Golas et al. | 164/437 X |

*Primary Examiner*—Nicholas P. Godici
*Assistant Examiner*—Kenneth F. Berg
*Attorney, Agent, or Firm*—Carothers & Carothers

[57] ABSTRACT

A shrouding sleeve for removable insertion between a tundish and an underlying mold to vertically enshroud a liquid stream issuing from the tundish to the mold wherein the shrouding sleeve consists of upper and lower substantially rigid sleeve portions. The upper sleeve is removably secured to the underside of the tundish and the lower sleeve is removably insertable for vertical alignment between the upper sleeve and the underlying mold. An annular flange is annularly secured to the bottom of the upper sleeve, and in a similar manner, annular flanges are also secured to the top and bottom of the lower sleeve. Another annular flange is also secured to the top of the underlying mold. At least one of these annular flanges is under continuous bias in the vertical direction so that when the lower shrouding sleeve is transversely inserted into vertical alignment between the upper sleeve and the mold, all of the annular flanges engage adjacent mating flanges to form a continuous shrouding sleeve under seal. The peripheral edges of the flanges may be annularly beveled to permit initial guided sliding lead-in engagement of adjacent engaging flanges under compression.

12 Claims, 2 Drawing Figures

APPARATUS FOR SHROUDING IN A CONTINUOUS CASTING MACHINE

BACKGROUND OF THE INVENTION

The present invention relates to shrouding apparatus for oxygen-free continuous casting apparatus.

It is a long-recognized practice to shroud or surround the stream of molten metal with an inert gas between the tundish and underlying mold in order to eliminate the contamination of the streaming molten metal.

Examples of present day shrouding arrangements for continuous casting apparatus are illustrated in U.S. Pat. Nos. 3,439,735; 3,482,621; 3,616,843; 3,756,305 and 3,766,961.

Most present day tundish-to-mold shrouding arrangements are overly complex in structure, are constructed such that the argon gas hoses must be moved with the shroud when it is swung out of the way, require the mold to be reciprocated or lowered before the shrouding arrangement can be inserted or removed laterally from between the tundish and mold, and provide no means for quickly connecting and disconnecting the shroud from the launder.

SUMMARY OF THE INVENTION

The shrouding apparatus of the present invention consists of upper and lower substantially-rigid sleeve portions. The upper sleeve removably secured to the underside of the tundish, while the lower sleeve remains removably insertable for vertical alignment between the upper sleeve and the underying mold. A first annular flange is annularly secured to the bottom of the upper sleeve, and a second annular flange is annularly secured to the top of the lower sleeve for vertical face engagement between these annular flanges when the lower sleeve is removably inserted by transversely positioning it into vertical alignment between the upper sleeve and the underlying mold.

A third annular flange is annularly secured to the bottom of the lower sleeve, and a fourth annular flange is secured to the underlyling mold for vertical face engagement between these two latter-mentioned annular flanges when the lower sleeve is removably inserted by transversely positioning it into vertical alignment between the upper sleeve and the underlying mold.

At least one of these four mentioned flanges is mounted for limited vertical movement in the vertical direction, and it is biased continually to urge it into vertical face engagement with an engaged adjacent one of the other flanges. This insures a good seal, and further permits ease of insertion and removal of the lower sleeve laterally from between the upper sleeve and the underlying mold.

To facilitate insertion and removal of the lower sleeve from between the upper sleeve and the underlying mold, the flanges are preferably provided with annularly-beveled peripheral edges to permit initial guided sliding lead-in and engagement of adjacent engaged flanges under compression of the vertical bias applied to at least one of the flanges as previously described.

One manner in which this vertical bias may be provided is to provide an annular back-up flange which is annularly secured about either upper sleeve or the lower sleeve adjacent one of the afore-mentioned flanges, and this said one of the aforesaid flanges is mounted for limited vertical movement relative to this back-up flange. Compression springs are then disposed between the back-up flange and this flange of permitted vertical movement for continually urging the flange vertically away from the back-up flange. In order to seal in the argon gas, a flexible seal annularly joins and seals the outer peripheral edges of the back-up flange and its adjacent flange which is permitted to vertically move within limitations.

Also, means for introducing gas under pressure into the interior of the shrouding arrangement is accomplished by a passage in or through the upper sleeve. Thus, since the upper sleeve is removably secured to the underside of the tundish, it is not necessary to move the argon hoses when the lower shroud sleeve is swung out of the way.

Furthermore, the lower sleeve is also provided with an arrangement for quickly connecting and disconnecting the lower shroud sleeve to a launder, so that the lower sleeve may be swung with the launder laterally, yet quickly removed when desired. This quick connect-/disconnect arrangement is preferably provided in the form of a slide tapered key and key socket arrangement.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE PREFERRED EMBODIMENT

Figure 1:
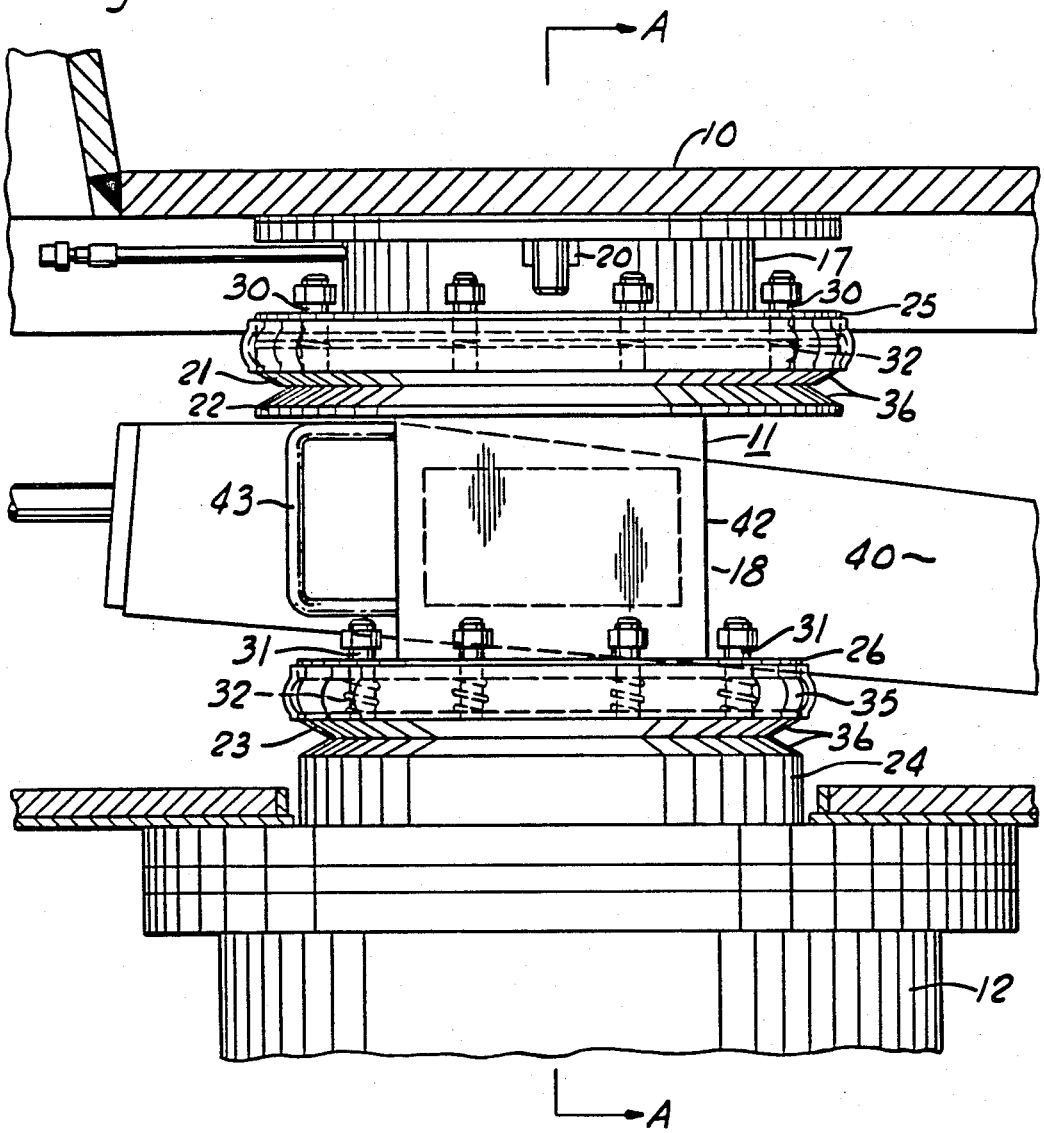
FIG. 1 is an elevational view of the shrouding arrangement of the present invention as shown in a continuous casting assembly.
Figure 2:
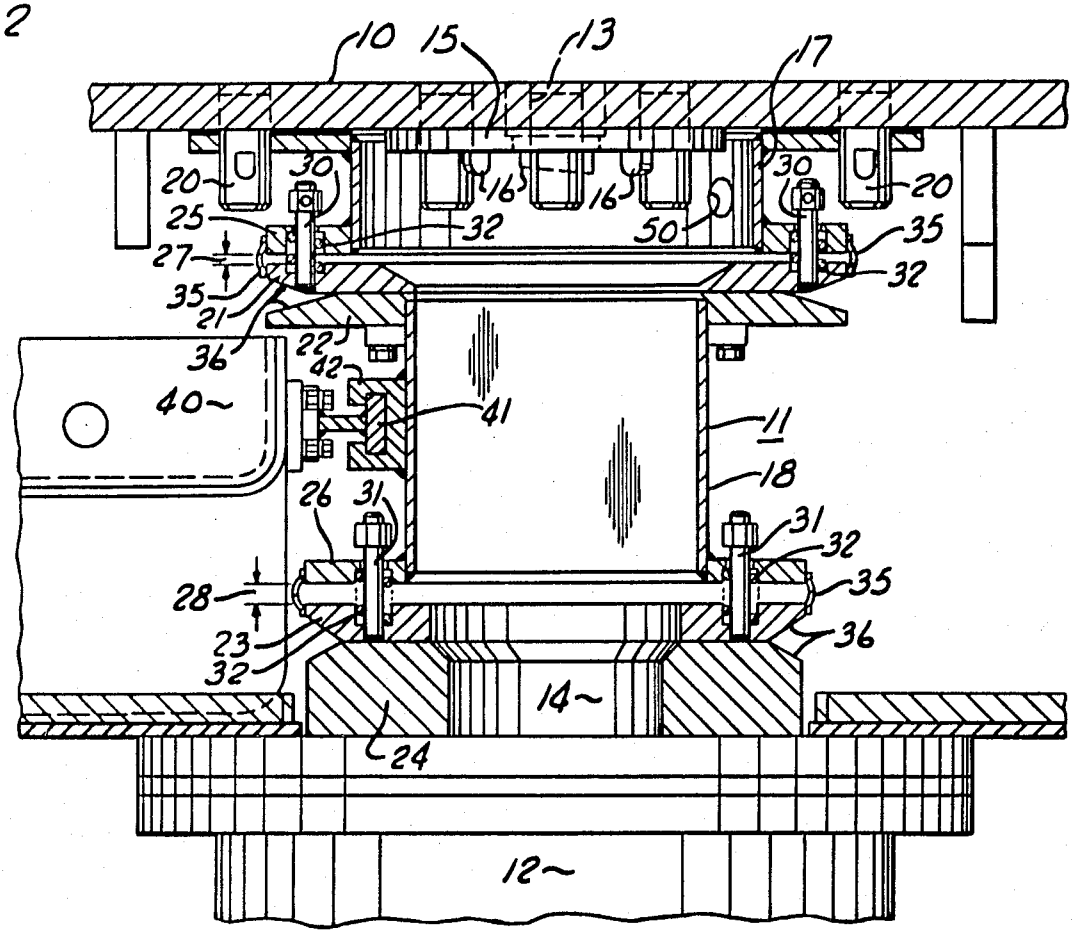
FIG. 2 is a view in vertical section of the shrouding and continuous casting assembly shown in FIG. 1 and as seen along section line A—A.

Referring to the drawings, there is basically illustrated the bottom portion of a tundish 10 and a shrouding arrangement 11 inserted between tundish 10 and underlying continuous casting mold 12 to vertically enshroud a stream of molten metal (not shown) issuing from tundish nozzle 13 into underlying continuous casting mold cavity 14 of continuous casting mold 12.

Pouring nozzle 13 is replaceable, and is retained in the bottom of tundish 10 by nozzle retainer plate 15, which is secured in place by means of conventional wedge pins 16.

The shrouding sleeve or arrangement 11, in fact, consists of two parts, an upper substantially rigid sleeve portion 17 and a lower substantially rigid sleeve portion 18. Upper sleeve 17 is removably secured to the underside of tundish 10 by means of conventional wedge key and pin arrangements 20, while the lower sleeve 18 remains removably insertable for vertical alignment between upper sleeve 17 and underlying mold 12.

A first annular flange 21 is annularly secured to the bottom of upper sleeve 17. A second annular flange 22 is annularly secured to the top of lower sleeve 18 for vertical face engagement with first annular flange 21, as illustrated in the Figures.

In a similar fashion, a third annular flange 23 is secured to the bottom of lower sleeve 18, and a fourth annular flange 24 is secured to the top of underlying continuous casting mold 12 for vertical face engagement with third annular flange 23 as illustrated in the Figures.

Vertical bias means is provided on the shrouding arrangement for continually urging annular flanges 21 and 23 into vertical face engagement with the corresponding engaged adjacent annular flanges 22 and 24, respectively.

This vertical bias means is here provided in the form of annular back-up flanges 25 and 26, which are annularly secured about upper sleeve 17 and lower sleeve 18 respectively, and their respective annular flanges 21 and 23 are mounted for limited vertical movement relative to these respective back-up flanges as indicated by the respective vertical gaps 27 and 28.

Annular flanges 21 and 23 are guided for their vertical movement relative to back-up flanges 25 and 26 by means of guide pins 30 and 31 respectively. Compression springs 32 are disposed between the back-up flanges and these vertically-movable flanges for continually urging the vertically-movable flanges away from the back-up flanges, thereby always creating a tight seal between adjacent engaging flange pairs 21 and 22 and adjacent engaging flange pairs 23 and 24.

In order to minimize the escape of argon gas from between back-up flange 25 and annular flange 21, and from between back-up flange 26 and annular flange 23, flexible bellow-like seals 35 annularly join and seal the outer peripheral edges of the back-up flanges and their respective vertically-movable annular flanges.

All four annular flanges 21, 22, 23 and 24 are provided with annularly-beveled peripheral edges 36 to permit initial guided sliding lead-in engagement of adjacent engaged flanges under the compression of springs 32. Thus, because of this arrangement, it is not absolutely necessary to lower continuous casting mold 12 for the insertion of lower shroud sleeve 18 between upper sleeve 17 and underlying mold cavity 14. These lead-in beveled edges 36, when initially engaged, will cause springs 32 to compress and permit lower shroud sleeve 18 to be slid laterally into position. Lower sleeve 18 may be slid laterally into position by laterally-swingable launder 40, which laterally swings in a conventional manner, as lower sleeve 18 is detachably secured to launder 40, by a quick-connect/disconnect wedge key in the form of wedge key 41, which is slidably received in wedge key socket 42. Lower shroud sleeve 18 may be quickly detached from launder 40 by pulling on handle 43.

Means in the form of gas inlet passage 50 is provided in upper sleeve 17 in order to introduce a gas such as argon under pressure into the interior thereof. Thus, in view of the fact that this gas inlet 50 remains stationary with shroud sleeve 17 and tundish 10, eliminates the need for moving gas hoses when lower shroud sleeve 18 is removed or inserted.

Another feature which should be recognized is that the outside diameter of annular flanges 21 and 22 is larger than the outside diameter of the lower set of annular flanges 23 and 24, and this protects the bottom bellows seal 35 for spillover should the shroud body or sleeve 18 be transversely passed through the stream of molten metal issuing from pouring nozzle 13, as spillover issuing down from larger diameter flange 22 will not pour onto smaller diameter bellows seal 35.

Also, if desired, aluminum wire may be fed through the thick mold top plate or annular flange 24 below the surface at which it mates with the shroud sleeve 18, in a conventional manner.

I claim:

1. In a shrouding apparatus including a substantially-rigid shrouding sleeve for removable insertion between a tundish and an underlying mold to vertically enshroud a liquid stream issuing from the tundish into an underlying mold, the improvement comprising, said shrouding sleeve consisting of upper and lower substantially rigid sleeve portions, means for securing said upper sleeve to the underside of a tundish while said lower sleeve remains removably insertable for vertical alignment between said upper sleeve and an underlying mold, a first annular flange annularly secured to the bottom of said upper sleeve, a second annular flange annularly secured to the top of said lower sleeve for vertical face engagement with said first annular flange when said lower sleeve is removably inserted by transversely positioning it into vertical alignment between said upper sleeve and an underlying mold, a third annular flange annularly secured to the bottom of said lower sleeve, a fourth annular flange, means for securing said fourth annular flange to an underlying mold for vertical face engagement with said third annular flange when said lower sleeve is removably inserted by transversely positioning it into vertical alignment between said upper sleeve and an underlying mold, and vertical bias means mounted on the shrouding sleeve for continually urging at least one of said flanges into vertical face engagement with an engaged adjacent one of said flanges.

2. The shrouding apparatus according to claim 1, said flanges having annularly beveled peripheral edges to permit initial guided sliding lead-in engagement of adjacent engaged flanges under compression of said vertical bias means.

3. The shrouding apparatus according to claim 1, said vertical bias means including an annular back-up flange annularly secured about one of said upper and lower sleeves adjacent at least one of said first and third flanges, said one of said flanges mounted for limited vertical movement relative to said back-up flange, and compression spring means disposed between said back-up flange and said one of said flanges for continually urging said one of said flanges vertically away from said back-up flange.

4. The shrouding apparatus according to claim 3, including flexible seal means annularly joining and sealing the outer peripheral edges of said back-up flange and said one of said flanges.

5. The shrouding apparatus according to claim 4, wherein said vertical bias means is provided for said first flange and also for said third flange.

6. The shrouding apparatus according to claim 4, wherein said one of said flanges is said third flange, said second flange being larger in diameter than said third and fourth flanges.

7. The shrouding apparatus according to claim 1, including means in said upper sleeve for introducing a gas under pressure into the interior thereof.

8. In a casting apparatus including a substantially-rigid shrouding sleeve for removable insertion between a tundish and an underlying mold to vertically enshroud a liquid stream issuing from the tundish into an underlying mold, the improvement comprising, said shrouding sleeve consisting of upper and lower substantially rigid sleeve portions, means for securing said upper sleeve to the underside of a tundish while said lower sleeve remains removably insertable for vertical alignment between said upper sleeve and an underlying mold, a first annular flange annularly secured to the bottom of said upper sleeve, a second annular flange annularly secured to the top of said lower sleeve for vertical face engagement with said first annular flange when said lower sleeve is removably inserted by transversely positioning it into vertical alignment between said upper sleeve and an underlying mold, a third annular flange annularly secured to the bottom of said lower sleeve, a fourth annular flange, means for securing said fourth annular flange to an underlying mold for vertical face engagement with said third annular flange when said lower sleeve is removably inserted by transversely positioning it into vertical alignment between said upper sleeve and an underlying mold, and vertical bias means mounted on the shrouding sleeve for continually urging at least one of said flanges into vertical faces engagement with an engaged adjacent one of said flanges, said tundish having an outlet nozzle, said underlying mold disposed vertically below said tundish nozzle and having a casting cavity for receiving molten metal streaming from said nozzle, said upper sleeve secured to said tundish and coaxially with said nozzle, said fourth flange secured to said underlying mold and coaxially with said casting cavity.

9. The casting apparatus according to claim 8, including a laterally movable launder, said lower said removably secured to a side of said launder for lateral movement therewith.

10. The casting apparatus according to claim 9, wherein said lower sleeve is removably connected to said launder with a slide tapered key and key socket arrangement.

11. The casting apparatus according to claim 8, wherein the top of said upper sleeve is removably secured to the underside of said tundish.

12. The casting apparatus according to claim 11, wherein said upper sleeve is removably secured to said tundish with wedge pin means.

* * * * *